US009936538B2

(12) United States Patent
Bernstein

(10) Patent No.: US 9,936,538 B2
(45) Date of Patent: Apr. 3, 2018

(54) RADIATOR ELEMENT

(76) Inventor: Al Bernstein, Günzburg (DE)

( * ) Notice: Subject to any disclaimer, the term of this patent is extended or adjusted under 35 U.S.C. 154(b) by 577 days.

(21) Appl. No.: 14/417,143

(22) PCT Filed: Jul. 24, 2012

(86) PCT No.: PCT/EP2012/003119

§ 371 (c)(1),
(2), (4) Date: May 27, 2015

(87) PCT Pub. No.: WO2014/015883

PCT Pub. Date: Jan. 30, 2014

(65) Prior Publication Data

US 2015/0341987 A1 Nov. 26, 2015

(51) Int. Cl.

| | |
|---|---|
| ***A45D 20/40*** | (2006.01) |
| ***F24C 7/00*** | (2006.01) |
| ***F26B 3/30*** | (2006.01) |
| ***H05B 3/02*** | (2006.01) |
| ***H05B 3/06*** | (2006.01) |
| ***H05B 3/12*** | (2006.01) |
| ***H05B 3/42*** | (2006.01) |
| ***H05B 3/54*** | (2006.01) |
| ***H05B 3/26*** | (2006.01) |
| ***H05B 3/48*** | (2006.01) |

(52) U.S. Cl.

CPC ..... *H05B 3/026* (2013.01); *H05B 3/06* (2013.01); *H05B 3/12* (2013.01); *H05B 3/265* (2013.01); *H05B 3/42* (2013.01); *H05B 3/48* (2013.01); *H05B 3/54* (2013.01); *H05B 2203/003* (2013.01); *H05B 2203/005* (2013.01); *H05B 2203/007* (2013.01); *H05B 2203/014* (2013.01); *H05B 2203/032* (2013.01)

(58) Field of Classification Search

None

See application file for complete search history.

(56) References Cited

U.S. PATENT DOCUMENTS

| | | | | | |
|---|---|---|---|---|---|
| 1,980,528 | A | * | 11/1934 | Hubl | H05B 3/342 219/528 |
| 2,617,009 | A | * | 11/1952 | Hasley | H05B 3/06 174/77 R |
| 2,659,795 | A | * | 11/1953 | Boggs | H05B 3/06 174/75 R |
| 2,807,696 | A | * | 9/1957 | Boggs | H05B 3/06 174/75 R |
| 2,876,322 | A | * | 3/1959 | Boggs | H05B 3/06 174/77 R |
| 3,113,284 | A | * | 12/1963 | Van Inthoudt | H05B 3/06 174/76 |
| 3,403,368 | A | * | 9/1968 | Scardina | H05B 3/00 174/77 R |

(Continued)

FOREIGN PATENT DOCUMENTS

| | | |
|---|---|---|
| EP | 0199566 A2 | 10/1986 |
| JP | 19860091152 | 10/1986 |

*Primary Examiner* — Thor Campbell

(74) *Attorney, Agent, or Firm* — Smartpat PLC

(57) ABSTRACT

The invention relates to a an electric radiator element having multiple heating zones for the production of energy-efficient eco-design applications, radiator heating flanges and radiator heating pipes in the low-voltage range, having integrated radiators which increase the heating output of a heater resistor without the additional consumption of energy.

6 Claims, 2 Drawing Sheets

(56) References Cited

U.S. PATENT DOCUMENTS 3,500,444 A * 3/1970 Wilbur ..... B28B 23/00 219/461.1
3,631,525 A * 12/1971 Brasch ..... F24H 3/0405 219/532
3,812,320 A * 5/1974 Borgren ..... F24D 13/02 219/213
3,839,623 A * 10/1974 Portmann ..... H05B 3/06 174/75 B
4,001,547 A * 1/1977 Boggs ..... F24H 9/1818 29/611
4,069,410 A * 1/1978 Keep, Jr. ..... H05B 3/56 174/109
4,152,578 A * 5/1979 Jacobs ..... H05B 3/04 219/536
4,186,369 A * 1/1980 Attridge ..... H01C 1/02 219/541
4,197,449 A * 4/1980 Fessenden ..... H05B 3/34 219/528
4,388,523 A * 6/1983 Keep, Jr. ..... H05B 3/06 174/77 R
5,198,641 A * 3/1993 Nagano ..... H05B 3/46 219/523
5,550,350 A * 8/1996 Barnes ..... E01C 11/265 219/213
5,941,482 A * 8/1999 Santagata ..... E01B 7/24 219/541
6,147,308 A * 11/2000 Santagata ..... E01B 7/24 174/75 R
6,350,969 B1 2/2002 Rothchild
6,433,318 B2 * 8/2002 Danko ..... H05B 1/02 219/402
7,180,040 B2 * 2/2007 Jones ..... H05B 3/06 174/84 C
7,182,654 B1 * 2/2007 Gracki ..... F24C 7/06 219/452.12
7,675,008 B2 * 3/2010 Arbour-Neagoe ... B21D 39/046 174/652
2004/0195234 A1 10/2004 Kaesler
2007/0045295 A1 * 3/2007 Hays ..... B41J 2/0057 219/647
2015/0341988 A1 * 11/2015 Messmer ..... H05B 3/44 392/422

* cited by examiner

RADIATOR ELEMENT

TECHNICAL FIELD

The invention relates to a novel type of electric radiator element for the production of energy-efficient applications and radiator heating flanges and to radiator heating pipes for energy efficient solar heating systems in the extra-low-voltage and low-voltage range having integrated radiators.

BACKGROUND

Known electrical heating conductors, heating wires, heating elements, heating flanges and heating rods, also electrical heating cell conductors, according to the state of the art have the disadvantage that due to the characteristics of heating resistors new eco-design products with reduced energy consumption cannot be realized without losses, because for the heating of a particular electrical resistance of defined dimensions to a certain temperature, at least a certain power is required.

A significant environmentally protective energy saving and reduction of primary energy demand for electric heating elements and their applications, such as heating flanges or heating rods for heating systems, is not possible according to the prior art without loss of size and power.

SUMMARY

The present invention is based on the object of creating a new radiator element, the dimensions and heating power of which is increased without additional energy consumption. The radiator element is to respond and heat up quickly, be maintenance-free, and with the smallest possible connected loads have the highest possible energy savings potential and the lowest possible consumption of primary energy.

The foregoing object is achieved with the features of independent claims. Advantageous embodiments are specified in the dependent claims.

A radiator element having multiple heating zones comprises at least one electric heating resistor and/or heating resistor segment, which is electrically connected to at least one tubular diffuse radiator made of a highly electrically conductive and highly heat conductive material, preferably metal with the lowest possible electrical resistance. Preferably, one segment of an electrical heating resistor is arranged between two tubular radiators.

The tubular diffuse radiators are conductively and radiatively heated to the temperature of the heating resistor without consuming additional electrical energy. The heating power of the charged radiators is proportional to temperature, cross-section and length.

The heating power of the heating resistor and/or resistor segment is supported by the radiators with the same temperature radiation, whereby the total heating power of the radiator elements is multiplied.

In a further embodiment for manufacturing a radiator heating rod or radiator heating flange, at least one resistor segment is arranged with at least one radiator in a metal tube so that the casing of the tube is heated by the radiators and the interposed resistor segments by isotropic thermal radiation.

In a further embodiment the radiator heating rod or radiator heating flange is embedded in magnesium oxide, wherein the radiators are appropriate in size and in solid form. In a further embodiment, the radiators are made in the form of brass tubes.

The diffuse radiators may be of any shape, dimensions and material properties, and are preferably made of highly thermally conductive aluminum tubes for maximum temperature up to 500° C. At least one tubular radiator is electrically and thermally connected to at least one resistor segment of any material, any shape, power and dimension, preferably by crimping.

Radiator elements with multiple heating zones can be made in any form, of any material, having any dimensions and any heating power and are preferably used for new eco-design applications such as energy efficient and environmentally friendly heating systems, energy efficient heating rods, heating flanges or ceramic heating elements.

DETAILED DESCRIPTION

Figure 1:
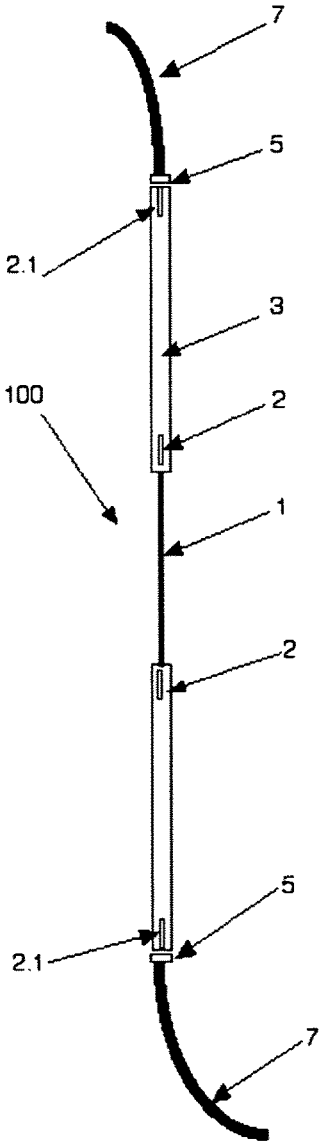
FIG. 1 shows a radiator element 100.

FIG. 1 shows a schematic representation of a radiator element 100, with a resistor segment 1. The electrical resistor 1, of any shape, material characteristics, power and dimension, is electrically connected at each of the terminal poles to a tubular diffuse radiator 3, preferably of aluminum of any form and dimensions, directly by means of crimping 2. The supply lines 7, preferably made of insulated copper braid wire, are connected for the electrical connection via wire ferrules 5, which fit into the aluminum tubes of the diffuse radiator 3, by means of crimping 2.1, so that no reactions between aluminum tubes 3, and copper wire cable 7, can occur.

Figure 2:
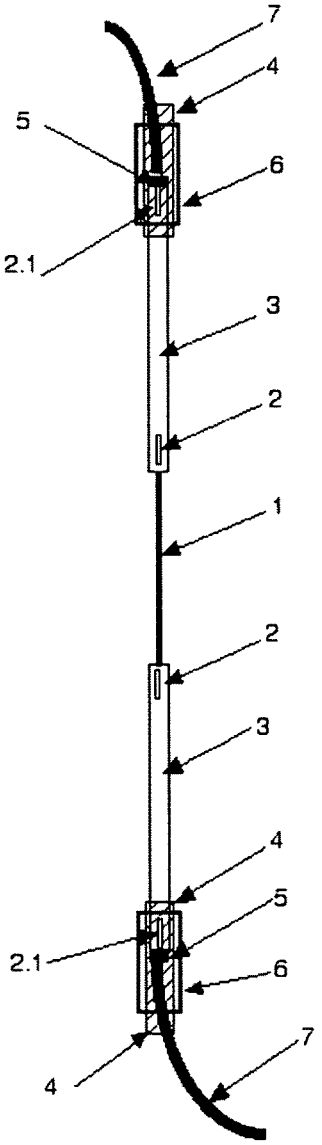
FIG. 2 shows a radiator element for installation in a heating system.

FIG. 2 shows a schematic representation of a radiator element 100 for installation in a heating profile. Braided glass sleeves 4 are put over the supply lines 7 and over the crimping 2.1 of the radiator 3 for electrical insulation, over which an aluminum tube 6 is arranged, which provides the necessary distance when the radiator element is incorporated into an application. The aluminum tube 6 is fixed to the aluminum pipe 3 of the radiator by pinching or crimping (not shown) and protected from displacement. In a further embodiment, the radiator 3 is formed solid.

Figure 3:
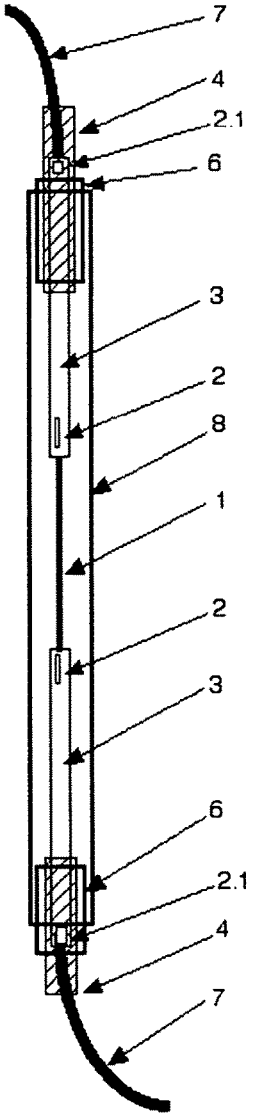
FIG. 3 shows a radiator element in the form of a heating tube.

FIG. 3 shows a radiator element 100 as in FIG. 2, described in the form of a radiator heating tube of any power arranged in a metal tube 8.

Figure 4:
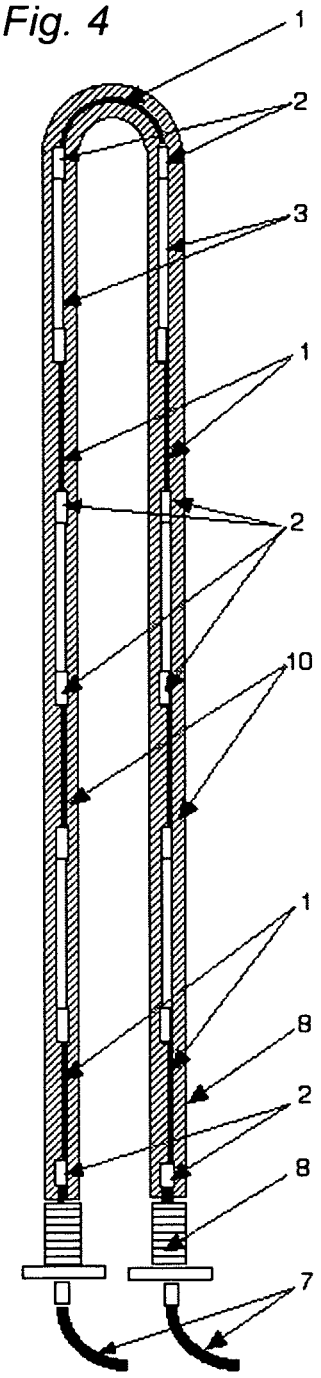
FIG. 4 shows a radiator heating flange with multiple heating zones.

FIG. 4 shows a schematic representation of a radiator heating flange with a radiator element 100 comprising multiple heating zones, as used for the heating of fluids. The multiple heating zones are formed by a plurality of resistor segments 1, and by radiators 3, which are electrically connected by crimping 2, and arranged in a steel tube 8, embedded in magnesium oxide 10. The radiators 3 are formed from solid aluminum rods. In a further embodiment, the radiators 3 are formed by brass pipes. The bending point of the flange is located in a zone of a resistor segment 1 that is formed with longer dimensions. The supply cables 7 are electrically connected to the resistor segments 1 by crimping 2, and are lead out of the flange. (Flange and screws are not shown)

Figure 5:
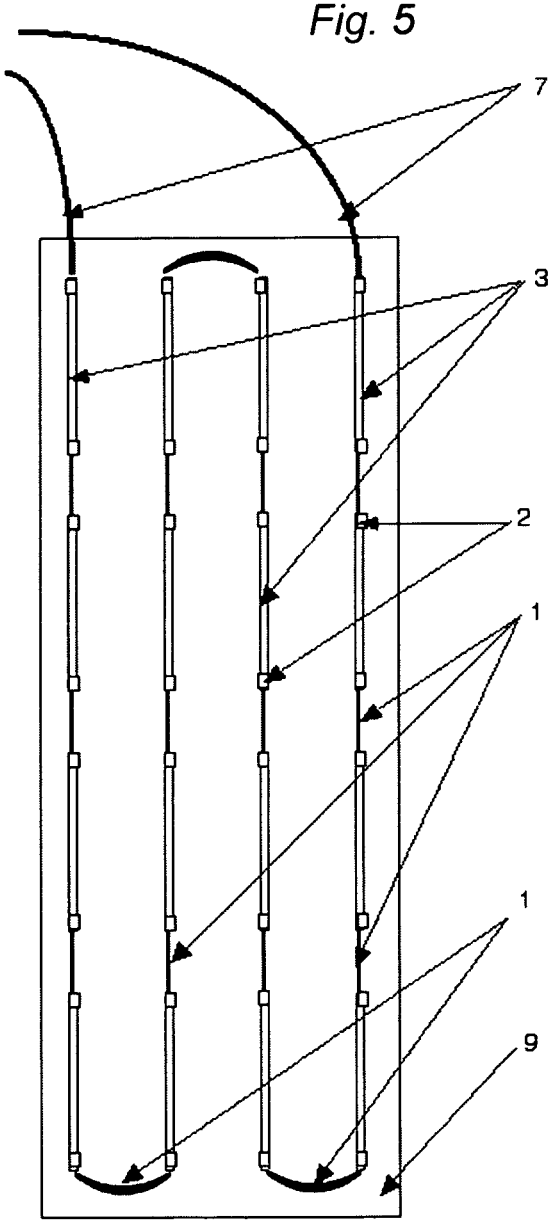
FIG. 5 shows a ceramic radiator element having multiple heating zones.

FIG. 5 shows in a further embodiment a given number of radiator elements 100, with multiple heating zones of defined dimensions and power in a ceramic bed 9, arranged in the form of a ceramic heater element. The individual radiator elements are electrically connected in parallel (not shown) or in series via the supply lines 7. The number and dimensions of the resistor segments 1 that are arranged between the diffuse radiators 3 and electrically connected by means of crimping 2, depends on the power and size of the heating circuit.

As illustrated, a radiator element (100) comprises at least one resistor segment (1) and at least one radiator (3). The radiator element (100) may have one or more heating zones. The radiator element (100) comprises at least one electrical heating resistor and/or heating resistor segment (1) electrically and thermally conductively connected in series to at least one radiator (3) by a connecting means (2). The radiator element (100) is electrically connected by connection cables (7).

A radiator element (100) with multiple heating zones comprises a plurality of heating resistor segments (1) that are electrically and thermally connected in series with a plurality of radiators (3). The radiator element (100) is electrically connected by connection cables (7). A respective segment of a heating resistor (1) may be formed of at least two twisted heating resistance wires and arranged electrically and heat-conductingly between two radiators (3).

The radiator heating element (100) may be arranged in a pipe (8) to form a heating tube and/or heating flange. Supply lines (7) may extend from the ends of the pipe (8) to provide an electrical connection. The radiator element (100) may be disposed in a ceramic bed (9).

The radiator (3) may be made of an aluminum tube. The radiator (3) may be formed from a solid aluminum bar. The radiator (3) may be electrically connected at the ends by crimping (2) with the heating resistor and/or heating resistor segment.

The heating resistor (1) may pass through a tubular radiator (3) and be electrically and thermally connected with the radiator (3) by crimping (2) at the tube ends.

The tubular radiator (3) may be made of aluminum and electrically connected by galvanized/silver plated wire ferrules (5) with supply lines (7) by crimping (2.1).

The supply lines (7), the crimping (2.1), and the ends of the radiators (3) that are crimped with the connection lines (7) may be are electrically insulated by braided glass sleeves (4). An aluminum tube (6) may be arranged over the braided glass sleeve insulation (4) and firmly attached by pinching or crimping with the tubular radiator (3).

The supply lines (7) may be formed of an insulated copper wire cable and may be insulated using a braided glass sleeve.

The radiator element (100) may be arranged in a tube (8) in magnesium oxide (10) for the formation of a heating tube and/or heating flange.

LIST OF REFERENCE NUMERALS

1 Resistor/resistor segment
2, 2.1 Crimp
3 Radiator
4 Braided glass sleeve
5 Wire ferrule
6 Spacer tube
7 Supply lines
8 Casing tube
9 Ceramic bed
10 Magnesium oxide
100 Radiator heating element

The invention claimed is:

1. An electrical radiator element (100) for use in energy efficient low-voltage electric heating systems, comprising:
- a first tubular, diffuse radiator (3) provided at a first end of the electrical radiator element (100);
- a second tubular, diffuse radiator (3) provided at a second end of the electrical radiator element (100);
- a heating resistor (1) connecting an inner end of the first tubular, diffuse radiator (3) with an inner end of the second tubular, diffuse radiator (3);
- a first electric supply line (7) connected to an outer end of the first tubular, diffuse radiator (3);
- a second electric supply line (7) connected to an outer end of the second tubular, diffuse radiator (3);
- a first braided glass sleeve (4) arranged over the first electric supply line (7) and the outer end of the first tubular, diffuse radiator (3); and
- a second braided glass sleeve (4) arranged over the second electric supply line (7) and the outer end of the second tubular, diffuse radiator (3).

2. The electrical radiator element (100) as in claim 1, further comprising:
- a first aluminum spacer tube (6) arranged over the first braided glass sleeve; and
- a second aluminum spacer tube (6) arranged over the second braided glass sleeve.

3. The electrical radiator element (100) as in claim 2, further comprising:
- a first aluminum spacer tube (6) arranged over the first braided glass sleeve and firmly attached to the first tubular, diffuse radiator (3) by pinching or crimping; and
- a second aluminum spacer tube (6) arranged over the second braided glass sleeve and firmly attached to the second tubular, diffuse radiator (3) by pinching or crimping.

4. The electrical radiator element (100) as in claim 3 arranged in a pipe (8) to form a heating tube and/or heating flange.

5. The heating tube and/or heating flange as in claim 4, wherein the pipe (8) is made of steel.

6. The heating tube and/or heating flange as in claim 4, wherein the radiator element (100) is disposed in a ceramic bed (9).

* * * * *